United States Patent [19]

Dunn

[11] 4,130,087

[45] Dec. 19, 1978

[54] STARTING BAR ATTACHMENT FOR STARTING GATES

[76] Inventor: Samuel G. Dunn, 15039-68th Ave., Surrey, British Columbia, Canada, V3S 2B8

[21] Appl. No.: 804,286

[22] Filed: Jun. 7, 1977

[51] Int. Cl.[2] ..... A01K 1/00

[52] U.S. Cl. ..... 119/15.5 R

[58] Field of Search ..... 119/15.5 R, 15.5 A

[56] References Cited

U.S. PATENT DOCUMENTS

| | | | |
|---|---|---|---|
| 2,868,168 | 1/1959 | Dunn | 119/15.5 R |
| 2,888,904 | 6/1959 | Purcell | 119/15.5 R |
| 2,955,570 | 10/1960 | Purcell | 119/15.5 R |
| 3,604,399 | 9/1971 | Mills | 119/15.5 R |

*Primary Examiner*—Russell R. Kinsey
*Assistant Examiner*—Daniel J. Leach
*Attorney, Agent, or Firm*—Fetherstonhaugh & Company

[57] ABSTRACT

Starting bar apparatus for a starting gate structure and including a starting bar in one or more section extending across the stalls of the gate structure at ground level and adjacent the rear ends of the stall. A plurality of downwardly-inclined rigid links are swingably connected at upper ends to the gate structure and swingably connected at lower ends to the starting bar. These links are inclined forwardly in the direction of the forward ends of the stalls so that when the bar is engaged by the hooves of horses starting out of the stalls, the links force the bar firmly into the ground so that it does not give or slip rearwardly relative to the horses.

21 Claims, 10 Drawing Figures

Figure 4:
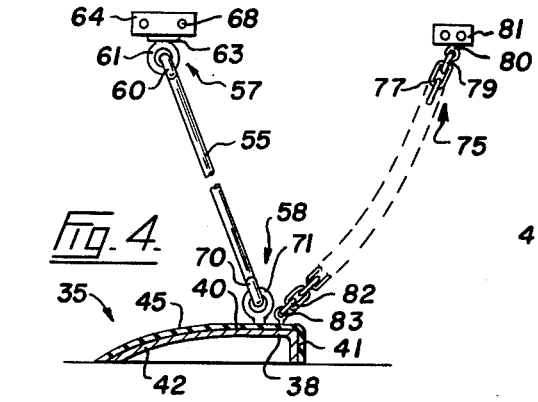

Fig. 1.
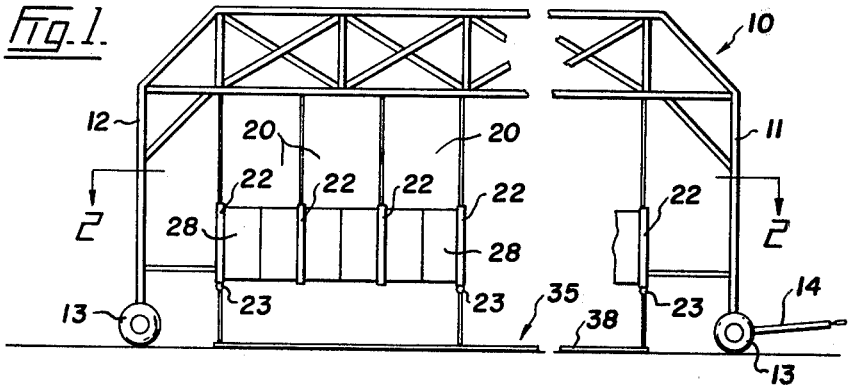
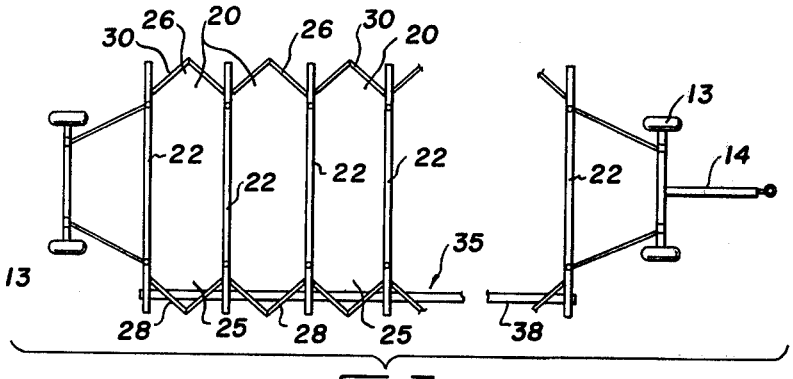
Fig. 2.
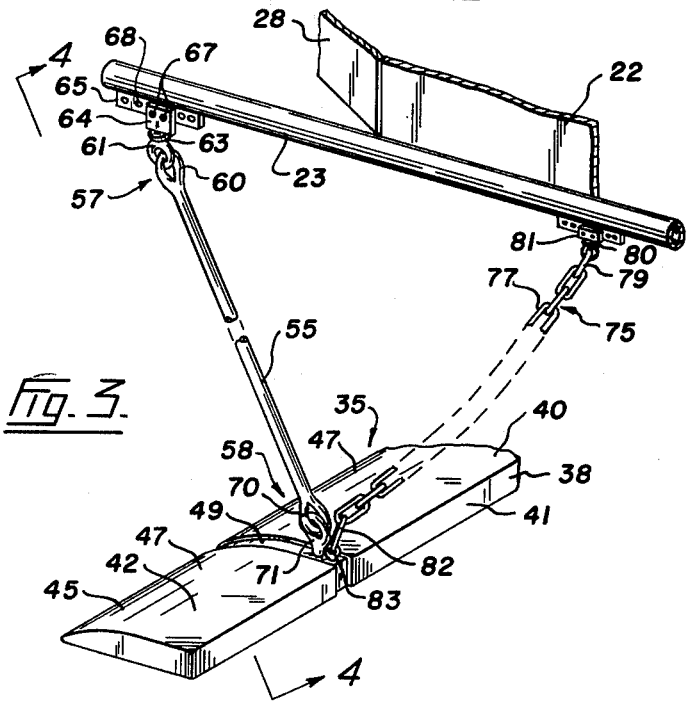
Fig. 3.

STARTING BAR ATTACHMENT FOR STARTING GATES

This invention relates to starting bar apparatus for the starting gates used at race tracks.

At the majority of race tracks of any consequence, starting gates are drawn across the track ahead of each race. Immediately after the horses start out of the stalls of these gates, the gates have to be moved off the track. During the initial surge at the start of the race, it often happens that the rear hooves of a horse break ground, causing the horse to strike part of the stall, or causing it to stumble and sometimes even fall. When this occurs, the horse and/or the jockey can be injured, the horse can be out of the race, and it at least has a delayed start.

A few race tracks use starting bars which are placed across the track below the rear ends of the stalls. This has to be done by hand, and the bars, which are usually in three or more sections, are frequently in the wrong place, that is, they are too far back from the horses hooves so that ground is broken, or they are too close to the hooves, in which case the hooves engage the ground behind the bar so that the ground can be broken at this point. In addition to this, if the bar is engaged by the horses feet and the ground is muddy, it is often driven down into the track surface so that it is very difficult to get its sections out before the horses on the track reach the starting point on the next lap. These problems are so common that only a small percentage of the race tracks use these starting bars.

Some attempts have been made to connect starting bars to the starting gates, and while these are better in some respects than the free bars, they do not solve all of the problems and have some problems of their own. The following three U.S. patents illustrate efforts in this direction.

U.S. Pat. Nos. 2,888,904 and 2,955,570 disclose a starting bar suspended from hand levers or hydraulic cylinders mounted on a starting gate. The starting bar is lowered onto the track surface, and as it is lowered at several points throughout its length, it is possible for some parts of the bar to be clear of the ground. There is nothing in the bar itself to stop it from shifting to the rear when engaged by a horses' hooves, and spikes or nails are provided for this purpose. These have to be driven down into the ground before the start of the race and have to be pried out of the ground after the race has commenced. Even then, when the bar is placed on relatively soft ground, there is no guarantee that it will not shift to the rear. When the bar does this, it has the same effect as a horse's hooves breaking ground. If the lifting mechanism fails to clear the bar or any part of the bar from the ground, movement of the gate to get it off the track will frequently bend or break the bar. It is difficult to move the gate off the track under these circumstances, and repairs or replacements may be required.

U.S. Pat. No. 3,604,399 also discloses a web mat arrangement suspended from a starting gate. The mat arrangement is supported by webs of belting material, and has to be adjusted up and down relative to the track surface. As a result parts of the mat may be suspended out of contact with the ground. This mat arrangement can be shifted rearwardly by the hooves. In fact, rearward movement of the mat tends to lift it up out of the ground since it is suspended from a plurality of points directly over the mat. In addition to this, the mat is, according to the patent specification, 3 or 4 feet wide. As a result, the back legs of the horses in the stalls will be standing on the mat so that the horses will be in unnatural positions more likely to cause stumbling than to prevent it. Another drawback is the obvious relatively great weight of the mat arrangement making it difficult to support it by or starting gate structure about 50 or 60 feet long and supported by wheels at the opposite ends only.

The present starting bar apparatus is an improvement over the starting bar arrangement shown in U.S. Pat. No. 2,868,168 dated Jan. 13, 1959, and eliminates the problems discussed above. This starting bar is connected to the starting gate by a plurality of rigid main links which are inclined downwardly and forwardly, with reference to the direction of movement of the horses, and the upper end of each link is connected to the gate by suitable swivel means. The bar rests on the ground under its own weight, and the links ensure that the bar is in its proper position for the start of the race. When the horses' hooves engage the starting bar, the rearward force created thereby has a tendency to move the bar in the same direction. This is prevented by the rigid links, and the lower ends of these links and, consquently the bar, swing downwardly under the impact, and this tends to drive the bar into the track surface so that the hooves in effect strike a rigid surface and cannot break ground; this gives them a positive start. In addition to this, the present invention includes means connected to one or both ends of the bar for lifting it off the track. However, even if the lifting mechanism malfunction, it is very easy to draw the gate off the track, since the inclined links, when the gate is moved, swing rearwardly relative to the direction of movement and will drag the gate over the track surface. The swivel connections of the links allow them to swing at this time so that there is no danger of bending or breakage.

Although not absolutely necessary, this bar apparatus preferably includes secondary links connecting the starting bar to the starting gate, said secondary links being inclined opposite to the inclination of the main links and being connected to the bar and the gate structure by suitable swivel connections. The secondary link is preferably in the form of a chain which is preferably slightly slack.

Starting bar apparatus in accordance with this invention for a starting gate structure divided by separators into a plurality of animal-retaining stalls, each stall having a rear entrance end and a forward exit end, comprises a starting bar extending across said stalls at ground level and adjacent the rear ends thereof, a plurality of downwardly-inclined rigid main links spaced from each other longitudinally of the bar and extending from the gate structure to said bar, said links being inclined forwardly in the direction of the forward ends of the stalls, and connectors connecting the upper ends and the lower ends of the links respectively to the gate structure and the starting bar, said connectors at the upper ends of the links comprising swivel means to allow the links to swing longitudinally and laterally of the stalls.

Figure 5:
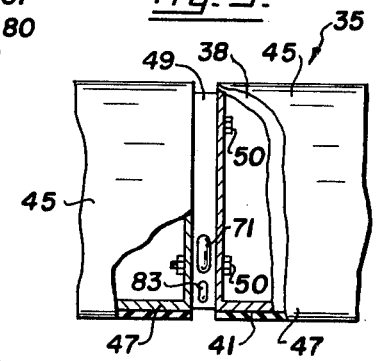
Figure 6:
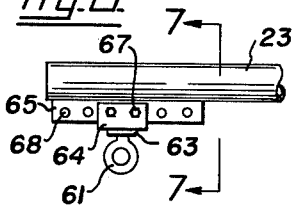
Figure 8:
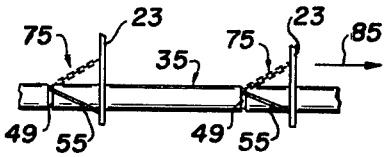
Figure 7:
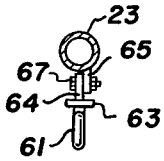
Figure 9:
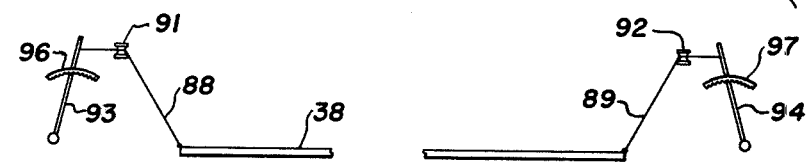
Figure 10:
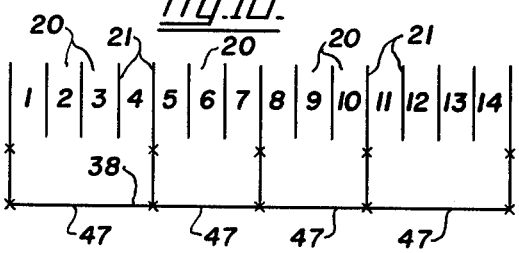

A preferred form of this invention is illustrated by way of example in the accompanying drawings, in which FIG. 1 is a diagrammatic side elevation of a starting gate incorporating the present invention, FIG. 2 is a diagrammatic horizontal section taken on the ine 2—2 of FIG. 1, FIG. 3 is an enlarged detail of a portion of the starting bar and the mounting thereof, FIG. 4 is a section taken on the line 4—4 of FIG. 3, FIG. 5 is an enlarged plan view of a portion of the starting bar, showing the interconnection of two sections of the bar, FIG. 6 is an enlarged fragmentary side elevation of part of the rear end of a stall wall or separator showing the connector for securing a bar link to this wall or separator, FIG. 7 is a sectional view taken on the line 7—7 of FIG. 6, FIG. 8 illustrates the position assumed by the starting bar relative to the gate structure when the bar is being dragged away by said structure, FIG. 9 diagramatically illustrates one form of mechanism for raising the starting bar relative to the starting gate, and FIG. 10 is a diagram showing bar connections to a 14-gate structure.

Referring the to drawings, 10 diagrammatically illustrates a starting gate structure having end frames 11 and 12, wheels 13, and a tongue 14 to be connected to a traction unit which moves the gate structure across the race track into and out of the starting position. This starting gate is divided into a plurality of stalls 20 separated from each other by walls or separators 22. FIG. 10 diagrammatically illustrates a 14-stall gate structure. In this example, each separator has a pipe 23 extending along its lower edge, see FIG. 3. Each stall has rear entrance end 25 and a forward exit end 26. A pair of rear gates 28 are provided at the rear end of each stall, and a pair of forward gates 30 are positioned at the forward end of the stall. This is a standard starting gate, and it includes all the usual well-known controls, and these do not need to be described or illustrated herein.

The starting bar apparatus 35 in accordance with this invention includes a starting bar 38 which, when the apparatus is in operation, extends across and beneath stalls 20 at ground level adjacent the rear ends 25 thereof, as shown in FIG. 2. This bar has a substantially horizontal top 40 with a vertical front flange 41 depending from its front edge, see FIGS. 3 and 4, and a rear flange 42 inclined downwardly from the rear edge of the bar top. The top surface is preferably covered with a non-skid material 45, such as rubber, suitable plastic, or the like.

Bar 38 may be in one length extending across all of the stalls, but is preferably made in a plurality of sections 47, because of the fact the starting gates of this type frequently have as many as 14 stalls. In the latter case, connector plates 49 are positioned between adjacent ends of the sections 47, and are connected thereto in any suitable manner, such as by bolts 50, as shown in FIG. 5. In FIG. 10, there are four sections 47 for a 14-stall gate, two of these sections each spanning four stalls, and two sections each spanning three stalls.

A plurality of laterally-spaced links 55 connect bar 38 to portions of the gate structure 10, there usually being a link at each end of each bar section 47. Each link is inclined downwardly from the gate structure and forwardly of the stalls 20, that is, in the direction of the forward ends 26 thereof. Swivel connectors 57 and 58 are provided at the upper end and the lowr end of each link for connecting the latter to the gate structure and the starting bar, respectively.

In this example, the swivel connector 57 for connecting the upper end of each link 55 to an adjacent portion of the gate structure 10 comprises a loop arrangement including intertwined loops 60 and 61. Loop 60 forms part of or is connected to the upper end of the link, while loop 61 is connected to a portion of the gate structure such as the rod or tube 23 extending along the lower edge of one of the separators 22. Loop 61 depends from a plate 63 having a bar 64 extending upwardly therefrom to overlap a similar but longer bar 65 secured to the under side of said tube 23. The bars 64 and 65 are adjustably secured together by bolts 67 extending through aligned holes 68 in the bars. This permits the upper ends of the main links to be adjusted longitudinally of the stalls to change the angle of these links thereby adjusting the effective length of the links relative to the ground.

The swivel connector 58 at the lower end of each link 55 is similar to swivel means 57. Swivel connector 58 comprises a loop arrangement including a loop 70 connected to or forming part of the lower end of the link and a loop 71 intertwined with loop 70 and connected to part of starting bar 38, such as one of the connector plates 49.

Starting bar 38 rest on the ground by its own weight. The links 55 extend upwardly and rearwardly therefrom to some of the separators 22 of the gate structure. The links 55 connect the bar to the gate structure, but any pressure against the bar, such as that exerted by hooves of horses when they start out of the gates, presses the bar in the rearward direction, but the links prevent the bar from moving rearwardly so that this pressure drives the bar against the track surface. The greater the pressure against the bar the further it digs down into the surface so that there is no danger of it slipping rearwardly under the impact of the horses hooves. If the gate structure is drawn laterally thereof, that is, in the direction across the stalls, the links 55 will swing a little and lift the bar out of the ground while allowing it to drag over the surface of the ground. In this way the traction unit pulling the gate pulls the starting bar out of the ground, and it is not necessary to do this by manual means.

The starting bar and link arrangement described so far will function satisfactorily, but it has one drawback. When the gate structure is drawn on the track, dragging the starting bar with it, the latter will not be in its proper place when the gate structure stops moving. At this time the links would be inclined laterally of the track and the gate structure, thereby necessitating shifting the bar into its proper position relative to the gate stalls.

This difficulty is eliminated by providing secondary links 75 connecting the starting bar to the gate structure, usually one near each main link 55. Each secondary link is inclined downwardly from the gate structure rearwardly of the stalls 20 opposed to or in the opposite direction to the incline of the main links. Although each secondary link may be the same as a main link with swivel connections at its upper and lower ends, the secondary link is preferably in the form of a flexible element such as chain 77 connected at its upper end to one of the stall tubes 23 and at its lower end of the starting bar 38 or one of the connector plates 49 thereof. The intertwined links of the chain form swivel connectors so that there is a swivel connector at each end of the chain.

The upper end link 79 of chain 77 forms part of a loop arrangement similar to loop arrangement 57 and including a loop 80 connected to a bar 81 which is adjustable connected to the tube 23 in the same manner as loop 61. The lower link 82 of the chain is connected by another loop 83 which is secured to one of the connector plates 49. This shifting of the upper end of the secondary link longitudinally of the stalls adjusts the angle of said link and thereby adjusts the effective length of the link relative to the ground.

Chain 77 is preferably a little slack to allow for a limited rearward movement of starting bar 38. This allows the bar to dig into the ground when struck by horses' hooves. When the starting gate structure is moved laterally of the track in the direction of arrows 85 in FIG. 8, the main and secondary links 55 and 75 tend to lift the bar relative to the ground so that it will drag over or above the surface thereof. Links 55 and 75 incline rearwardly relative to the direction of movement at this time, said movement generally being laterally of the track. The amount of this rearward incline is exaggerated in FIG. 8 for the sake of clarity. When this movement of the gate structure stops, the starting bar settles under its own weight into its proper position relative to the stalls.

It is preferable to provide means on the gate structure 10 for raising and lowering the starting bar. One way of accomplishing this is diagrammatically illustrated in FIG. 9. In this example, the opposite ends of bar 38 have cables 88 and 89 connected thereto. These cables extend upwardly and pass around pulleys 91 and 92 mounted on the structure 10 and extend to levers 93 and 94 swingably mounted on the gate structure, and having ratchet arrangements 96 and 97 for retaining these levers in different positions. In FIG. 9 bar 38 is on the ground, at which time levers 93 and 94 are inclined towards each other. When it is desired to lift the bar, one or both of the levers is or are swung outwardly until the bar lifts the desired distance. It will be noted that pulleys 91 and 92 are located forwardly of the bar so that when cables 88 and 89 lift it from the ground, they also pull it forwardly so that they swing links 55 around their upper pivotal connections to the gate structure.

It is obvious that any desired means may be utilized for raising and lowering the starting bar, such as suitable hydraulic mechanism. The mechanism shown from doing this job can also be altered by omitting one of the levers, for example, lever 93 and lever 94 would be used to lift one end only of the bar. In this case, the gate structure would have to be moved to the right as viewed in FIG. 9.

If it is necessary to adjust the angle of the main links 55, this can be done by removing bolts 67 and shifting bars 64 and loops 61 forwardly or rearwardly along tubes 23. Links 77 may be adjusted in the same manner. This adjusts the effective length of the links relative to the ground.

When it is desired to use this apparatus, the gate structure 10 is drawn or pushed onto the race track with starting bar 38 in the raised position. When the gate structure is positioned across the track, the starting bar is lowered into engagement with the ground. The horses are lead into the stalls in the usual manner, and the present apparatus does not interfere in any way since the links 55 and 75 are positioned below and in line with the stall separators. When the race starts, the rear hooves of some or all of the horses may strike bar 38 which prevents them from breaking ground, and the pressure of the hooves merely causes the links 55 to swing downwardly to drive the bar further into the ground. In other words, the greater the force the more securely the starting bar embraces or digs into the ground. Once the horses are away, it is a simple matter to raise the bar and then to draw or push the gate structure off the track. This can easily be accomplished by one or two men since it is not necessary to try to dig the bar out of the track by hand. The links maintain the starting bar in its correct position relative to the stalls at all times, so that there is no danger of the bar moving under the impact of the horses' hooves, and the hooves cannot get over the bar or cannot be to far in front of the bar if the horses are in their proper positions in the stalls at the start of the race.

I claim:

1. Starting bar apparatus for a starting gate structure divided by separators into a plurality of animalretaining stalls, each stall having a rear entrance end and a forward exit end, said bar apparatus comprising a starting bar extending across said stalls at ground level and adjacent the rear thereof, a plurality of downwardly-inclined rigid main links spaced from each other longitudinally of the bar and extending from the gate structure to said bar, said links being inclined forwardly in the direction of the forward ends of the stalls, and connectors connecting the upper ends and the lower ends of the links respectively to the gate structure and the starting bar, said connectors at the upper ends of the links comprising swivel means to allow the links to swing longitudinally and laterally of the stalls.

2. Starting bar apparatus as claimed in claim 1 in which said connectors at the lower ends of the links comprise swivel means.

3. Starting bar apparatus as claimed in claim 1 including means for adjusting the effective length of the links relative to the ground.

4. Starting bar apparatus as claimed in claim 1 in which the connectors at the upper ends of the links are connected to gate structure for adjustment forwardly and rearwardly relative to the stalls.

5. Starting bar apparatus as claimed in claim 1 in which the connector of the upper end of each link is secured to a separator of the gate structure.

6. Starting bar apparatus as claimed in claim 1 including means connected to the starting bar operable to swing the links and the bar forwardly and laterally of the stalls to raise said bar relative to the ground.

7. Starting bar apparatus as claimed in claim 2 including means connected to the starting bar operable to swing the links and the bar forwardly and laterally of the stalls to raise said bar relative to the ground.

8. Starting bar apparatus as claimed in claim 1 in which the starting bar comprises a substantially horizontal top, and a front flange depending from a front edge of said top and facing towards the forward end of the stalls.

9. Starting bar apparatus as claimed in claim 8 in which said starting bar comprises a rear flange inclined downwardly from a rear edge of said top.

10. Starting bar apparatus as claimed in claim 9 including a non-slip surface on said bar top.

11. Starting bar apparatus as claim in claim 1 in which the starting bar is formed in a plurality of longitudinally aligned sections, and including connector plates between said sections, and securing means releasably connecting each connector plate to adjacent ends of the bar sections, said connectors of the lower ends of the links being secured to said connector plates.

12. Starting bar apparatus as claimed in claim 1 comprising a plurality of downwardly-inclined secondary links spaced from each other longitudinally of the bar and extending from the gate structure to the bar, said secondary links being inclined rearwardly in the direction of the rearward ends of the stalls, and connectors connecting the upper ends and the lower ends of the secondary links respectively to the gate structure and the starting bar, said connectors at the upper ends of the secondary links comprising swivel means to allow the secondary links to swing longitudinally and laterally of the stalls.

13. Starting bar apparatus as claimed in claim 12 in which said connectors at the lower ends of the secondary links comprise swivel means.

14. Starting bar apparatus as claimed in claim 12 in which said secondary links comprise chains.

15. Starting bar apparatus as claimed in claim 14 in which said secondary links comprise slightly slack chains.

16. Starting bar apparatus as claimed in claim 12 including means connected to the starting bar operable to swing the links and the bar forwardly and laterally of the stalls to raise said bar relative to the ground.

17. Starting bar apparatus as claimed in claim 14 including means connected to the starting bar operable to swing the links and the bar forwardly and laterally of the stalls to raise said bar relative to the ground.

18. Starting bar apparatus as claimed in claim 12 in which the starting bar is formed in a plurality of longitudinally aligned sections, and including connector plates between said sections, and securing means releasably connecting each connector plate to adjacent ends of the bar sections, said connectors of the lower ends of the links being secured to said connector plates.

19. Starting bar apparatus for a starting gate structure divided by separators into a plurality of animalretaining stalls, each stall having a rear entrance end and a forward exit end, said bar apparatus comprising a starting bar extending across said stalls at ground level and adjacent the rear thereof, a plurality of downwardly-inclined rigid main links spaced from each other longitudinally of the bar and extending from the gate structure to said bar, said main links being inclined forwardly in the direction of the forward ends of the stalls, connectors connecting the upper ends and the lower ends of the main links respectively to the gate structure and the starting bar, said connectors at the upper ends of the main links comprising swinging means to allow the main links to swing longitudinally of the stalls, a plurality of downwardly-inclined and flexible secondary links spaced from each other longitudinally of the bar and extending from the gate structure to the bar and connected to said structure and said bar, said secondary links being swingable relative to the stalls, and means connected to the starting bar operable to swing the main links and the bar forwardly to raise said bar relative to the ground.

20. Starting bar apparatus as claimed in claim 19 in which said connectors at the upper ends of the main links comprise swivel means to allow the main links to swing laterally of the stalls, whereby said swing means shifts the bar laterally as well as forwardly.

21. Starting bar apparatus as claimed in claim 19 including means for adjusting the upper ends of the main links and the secondary links forwardly and rearwardly in relation to the stalls thereby adjusting the effect length of said links relative to the ground.

* * * * *